US012752212B2

(12) United States Patent
Kelly et al.

(10) Patent No.: US 12,752,212 B2
(45) Date of Patent: Oct. 6, 2026

(54) TOY FOR PRODUCING BUBBLES, SMOKE, AND SMOKE-FILLED BUBBLES

(71) Applicant: LightUpToys.com, LLC, Sellersburg, IN (US)

(72) Inventors: Joshua C. Kelly, New Albany, IN (US); Christopher D. Kelly, New Albany, IN (US); Max Armendariz Lalama, Sellersburg, IN (US)

(73) Assignee: LightUpToys.com LLC, Sellersburg, IN (US)

( * ) Notice: Subject to any disclaimer, the term of this patent is extended or adjusted under 35 U.S.C. 154(b) by 77 days.

(21) Appl. No.: 18/183,500

(22) Filed: Mar. 14, 2023

(65) Prior Publication Data

US 2023/0277953 A1 Sep. 7, 2023

Related U.S. Application Data

(63) Continuation-in-part of application No. 17/335,447, filed on Jun. 1, 2021, now Pat. No. 12,097,447.
(Continued)

(51) Int. Cl.
*A63H 33/28* (2006.01)
*A63H 5/00* (2006.01)
*A63H 33/22* (2006.01)

(52) U.S. Cl.
CPC ..... *A63H 33/28* (2013.01); *A63H 5/00* (2013.01); *A63H 33/22* (2013.01)

(58) Field of Classification Search
CPC ..... A63H 33/28
See application file for complete search history.

(56) References Cited

U.S. PATENT DOCUMENTS 2,566,296 A * 9/1951 Brosseit ..... A63H 33/28 222/211
4,245,430 A * 1/1981 Hoyt ..... A63H 30/04 446/175

(Continued)

FOREIGN PATENT DOCUMENTS

CN 211987109 U 11/2020
KR 20210148786 A * 12/2021 ..... A63H 33/28

OTHER PUBLICATIONS

Yoon, Machine Translation of KR-20210148786-A, uploaded Nov. 8, 2024, Espacenet, 5 pages.*

*Primary Examiner* — Michael D Dennis
*Assistant Examiner* — Matthew B Stanczak
(74) *Attorney, Agent, or Firm* — Jessica C. Ronald; Scott R. Cox

(57) ABSTRACT

A toy for producing bubbles, smoke, and smoke-filled bubbles, which includes a bubble solution reservoir connected to a housing via a shaft. A bubble producing engine and an air producing device, which is connected to an air duct, are secured within the housing. A smoke cartridge is connected to the air blower via an air channel, which channel flows through the air cartridge and joins with the air duct. A bubble and smoke discharge nozzle is secured to a second end of the air duct, and the nozzle includes a film producing assembly and a discharge orifice. A channel with a tubular structure has a first end is submerged within the solution reservoir and a second end is connected to the bubble film producing assembly. Smoke and air are pushed through the bubble film producing assembly to emit smoke-filled bubbles, smoke and bubbles through the discharge orifice.

8 Claims, 8 Drawing Sheets

Related U.S. Application Data

(60) Provisional application No. 63/269,647, filed on Mar. 21, 2022.

(56) References Cited

U.S. PATENT DOCUMENTS 4,589,138 A * 5/1986 Milner ..... A63H 3/28 446/175
4,637,007 A * 1/1987 Sakurai ..... A63H 3/28 446/175
5,035,665 A 7/1991 Sheng
5,297,979 A 3/1994 Amron
6,022,273 A 2/2000 Gabai et al.
6,024,623 A 2/2000 Menow et al.
6,200,193 B1 * 3/2001 Nadel ..... A63H 5/00 446/397
11,173,415 B1 * 11/2021 Yang ..... A63H 33/28
11,192,046 B2 12/2021 Pogue et al.
11,628,377 B2 * 4/2023 Pogue ..... A63J 5/025 472/65
2002/0071664 A1 * 6/2002 Aronie ..... A63H 33/28 392/404
2003/0064657 A1 * 4/2003 Pierson ..... A63H 19/14 446/24
2004/0259458 A1 * 12/2004 Fusco ..... A63H 33/28 446/15
2005/0003731 A1 * 1/2005 LaFata ..... A63H 33/26 446/24
2005/0148276 A1 * 7/2005 LaFata ..... A63H 33/26 446/18
2006/0116048 A1 * 6/2006 Choi ..... A63H 33/28 446/15
2007/0259594 A1 * 11/2007 Galbiati ..... A63H 5/00 446/15
2009/0017713 A1 * 1/2009 Chung ..... A63H 33/28 446/15
2011/0081820 A1 * 4/2011 Faecher ..... A63H 33/28 446/15
2012/0135666 A1 * 5/2012 Rosenzweig ..... A63H 33/22 446/242
2013/0065688 A1 * 3/2013 Podoloff ..... A63F 13/235 446/454
2015/0065006 A1 * 3/2015 Zimmerman ..... A63H 33/28 446/24
2015/0072586 A1 * 3/2015 Suh ..... A63H 33/042 446/91
2016/0018083 A1 1/2016 Kelly et al.
2019/0111358 A1 * 4/2019 Kelly ..... A63H 33/28
2020/0054959 A1 * 2/2020 Weigl, Jr. ..... A63H 33/28
2020/0398177 A1 * 12/2020 Peeples ..... A63H 33/28
2021/0379503 A1 * 12/2021 Kelly ..... A63H 33/22
2022/0088499 A1 * 3/2022 Pogue ..... A63J 5/025
2022/0143525 A1 * 5/2022 Lo ..... A63H 29/22
2022/0168662 A1 * 6/2022 Kelly ..... A63J 5/028
2022/0379232 A1 * 12/2022 Kelly ..... A63H 33/28
2023/0111031 A1 4/2023 Kelly et al.
2023/0135754 A1 * 5/2023 Yang ..... A63H 33/28 446/15
2023/0241527 A1 * 8/2023 Petrarca ..... A63H 33/28 446/16
2023/0277953 A1 * 9/2023 Kelly ..... A63H 33/22 446/15
2023/0277954 A1 * 9/2023 Kelly ..... A63H 30/04 446/15
2024/0066424 A1 * 2/2024 Kelly ..... A63H 33/28
2024/0149226 A1 * 5/2024 Kelly ..... B01F 23/232
2025/0001324 A1 * 1/2025 Kelly ..... A63H 33/28
2025/0159772 A1 * 5/2025 Kelly ..... A63H 33/28
2025/0249373 A1 * 8/2025 Wang ..... A63H 33/28
2025/0352923 A1 * 11/2025 Kelly ..... A63H 33/26
2025/0367564 A1 * 12/2025 Kelly ..... A63H 3/006
2026/0059612 A1 * 2/2026 Yang ..... A63H 33/28
2026/0124554 A1 * 5/2026 Huang ..... A63H 33/28

* cited by examiner

TOY FOR PRODUCING BUBBLES, SMOKE, AND SMOKE-FILLED BUBBLES

CROSS-REFERENCE

This application is a continuation-in-part of and claims the benefit of U.S. application Ser. No. 17/335,447 filed on Jun. 1, 2021 and further claims priority from provisional application Ser. No. 63/269,647, filed Mar. 21, 2022. All publications, patents and patent applications referred to herein are incorporated by reference in their entirety.

FIELD OF INVENTION

The invention relates to the technical field of novelty toys, and more particularly to a novelty toy that produces bubbles, smoke, and/or smoke-filled bubbles.

BACKGROUND OF THE INVENTION

Toys that produce bubbles and generate smoke are known. However, due to the overproduction of bubbles, overheating of oil and inadequate construction, many of these toys leak. Accordingly, the toys quickly become nonfunctional due to excess solution leaking into the internal electronic components of the toys. Moreover, the solution and oil leaks onto the hands of the users, which wastes large quantities of bubble solution and oil. Furthermore, these toys tend to overheat, which fries the internal electronics of the toys.

Furthermore, many known toys either create bubbles, fog, or fog filled bubbles. Known devices are not capable of creating bubbles, fog, and/or fog-filled bubbles in any combination either simultaneously or independently. Accordingly, these known toys are quite limited in the functions they perform.

SUMMARY OF THE INVENTION

A bubble, smoke, and smoke-filled bubble producing toy, which includes a bubble solution reservoir connected to a housing via a shaft. A bubble producing engine and an air producing device are secured within the housing. Connected to the air producing device is an air duct. A smoke cartridge is connected to the air blower via an air channel, which channel flows through the air cartridge and joins with the air duct. A bubble and smoke discharge nozzle is secured to a second end of the air duct, and the nozzle includes a film producing assembly and a discharge orifice. A channel with a tubular structure has a first end is submerged within the solution reservoir and a second end is connected to the film producing assembly.

DETAILED DESCRIPTION

FIGS. 1-4 show varying views of a toy that produces bubbles, fog, and fog-filled bubbles 10, while FIGS. 5-8 show various views of a housing 50 of the toy. The toy is, for example a bubble wand, similar to the one which is made by Applicant and disclosed in U.S. application Ser. No. 17/335,447, which application is incorporated by reference herein in its entirety. Advantageously, the toy produces bubbles, smoke and smoke-filled bubbles simultaneously or independently and in any combination.

Figure 1:
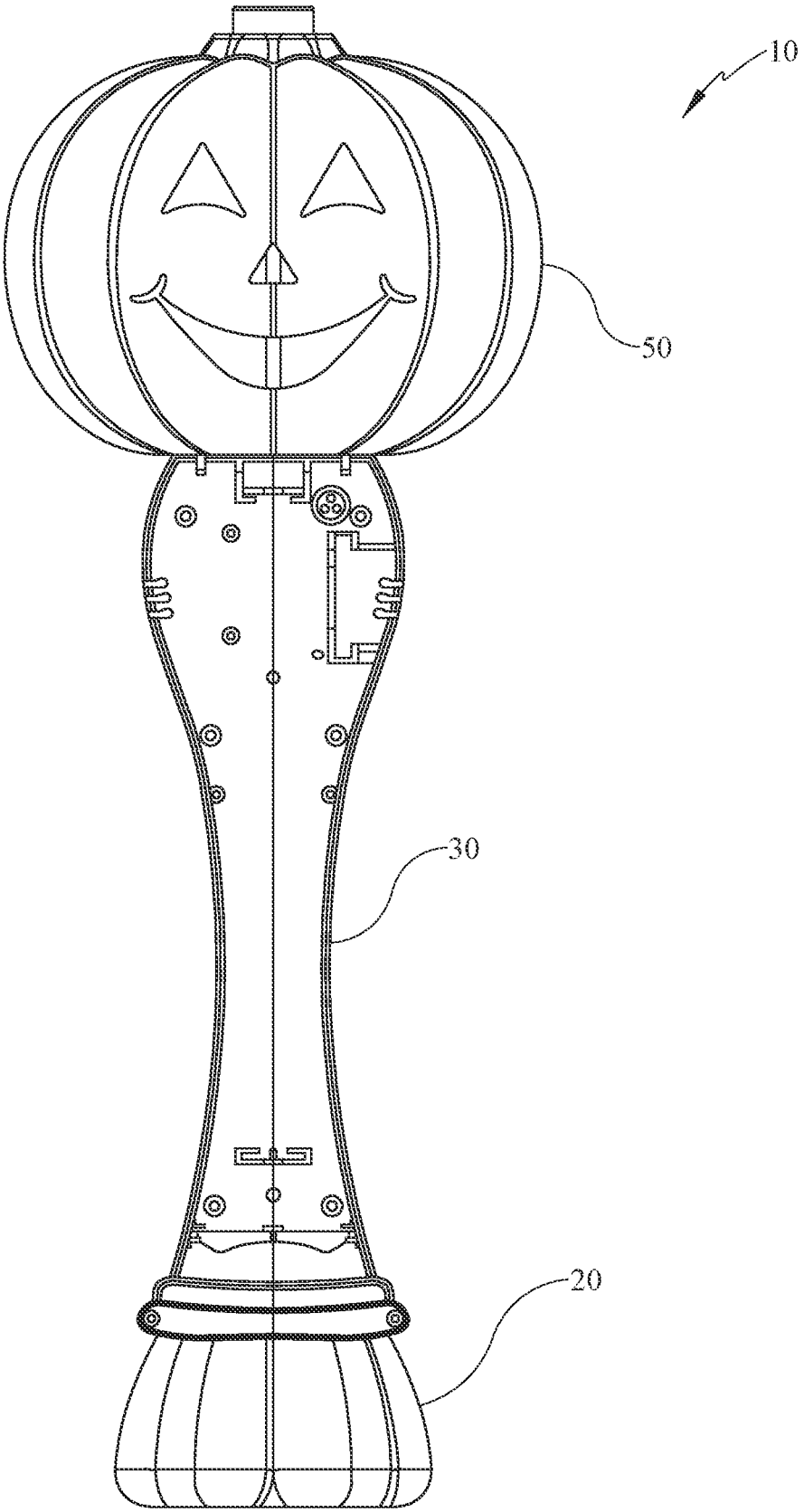
FIG. 1 is a front view of a toy that produces bubbles, smoke, and smoke-filled bubbles.
Figure 2:
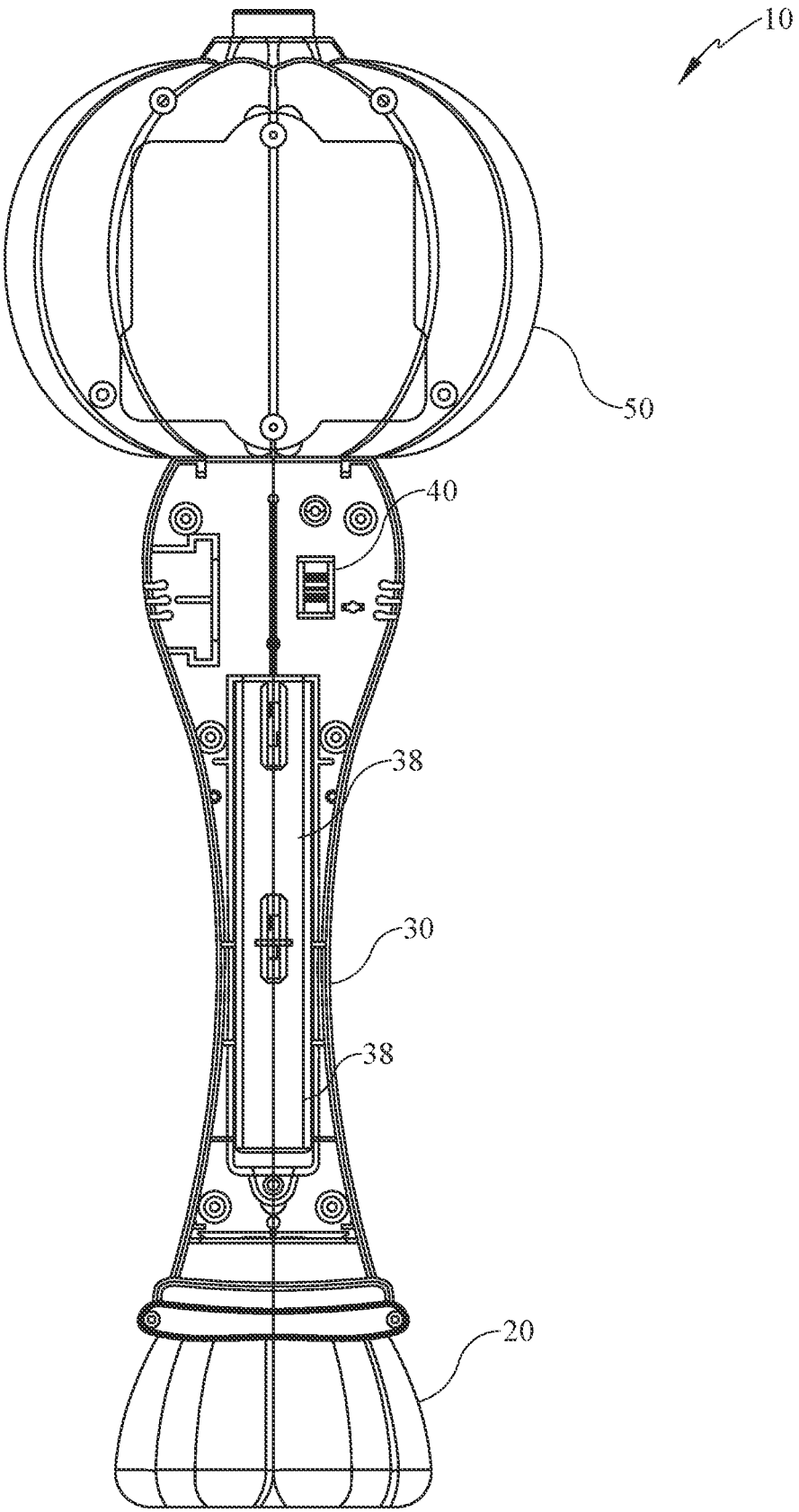
FIG. 2 is a back view of the toy that produces bubbles, smoke, and smoke-filled bubbles shown in FIG. 1.
Figure 3:
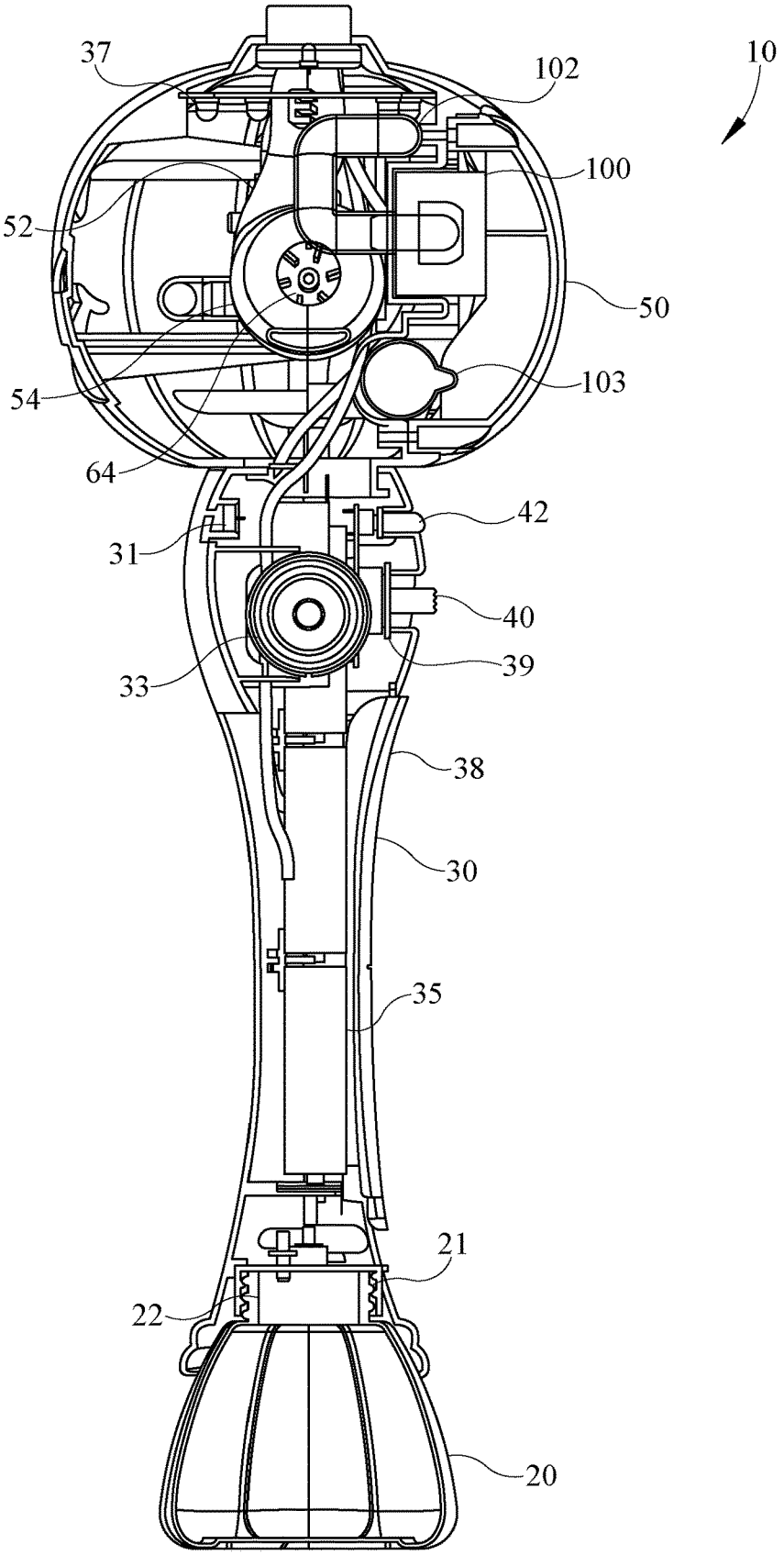
FIG. 3 is an open, side view of the toy that produces bubbles, smoke, and smoke-filled bubbles shown in FIG. 1.

As shown in FIGS. 1-3, the toy 10 includes a bubble solution reservoir 20 and a housing 50, which are connected via a shaft 30. The reservoir connects to the shaft, for example, by twisting or screwing the reservoir into ridges 21 that form a bottom portion of the shaft, see FIG. 3. The reservoir contains liquid, such as bubble solution, which transforms into bubbles when blown from a discharge orifice 86 that is located in a top portion of the housing, see FIGS. 5 and 6. Advantageously, the reservoir is easily refillable, the bubble solution is preferably nontoxic, and the solution is not slippery when it falls to the ground as bubbles.

Figure 4:
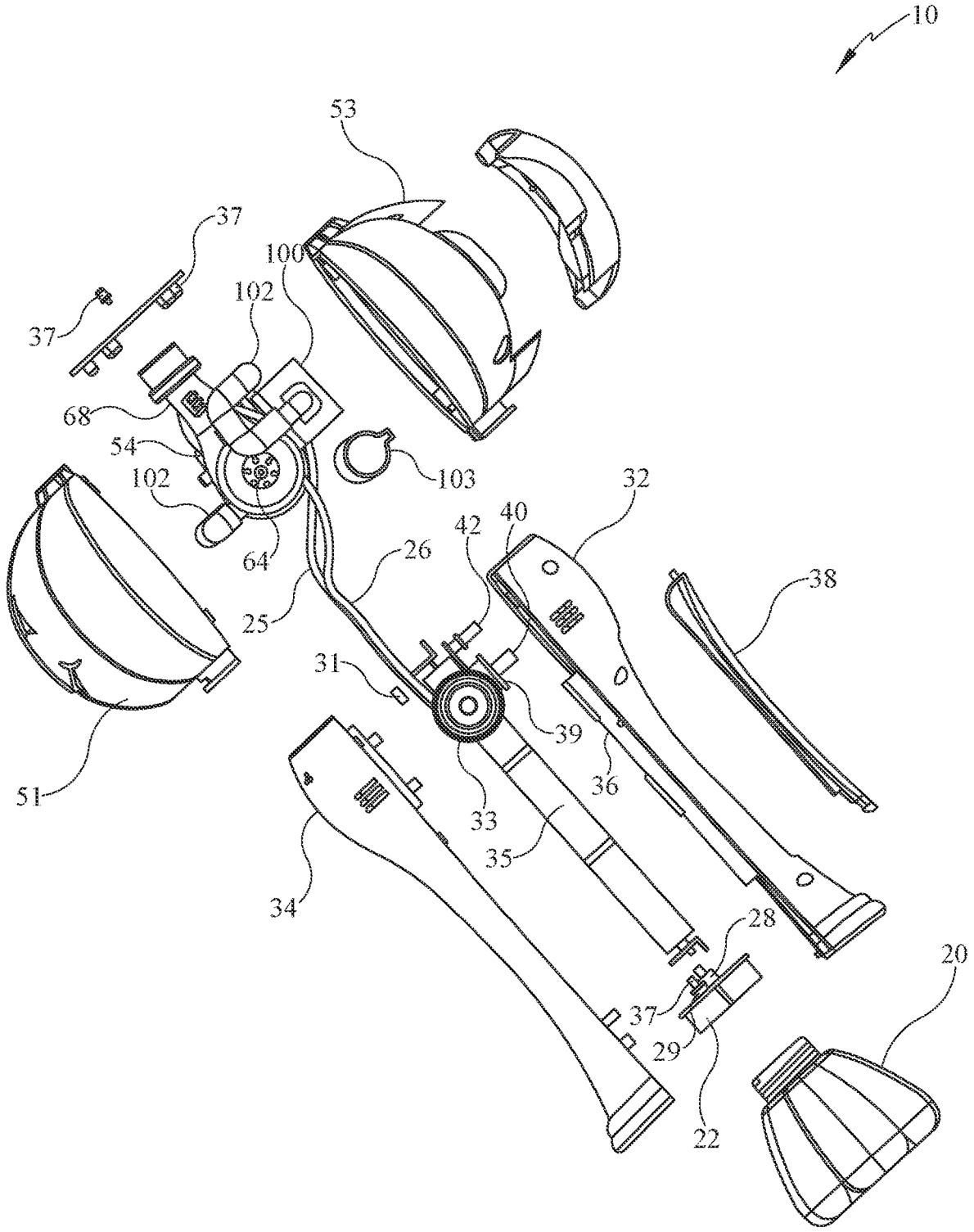
FIG. 4 is an exploded, side view of the toy that produces bubbles, smoke, and smoke-filled bubbles shown in FIG. 1.

As shown in FIGS. 3 and 4, the reservoir 20 includes a cover 22, that secures to or forms a top portion thereof. This cover prevents solution from leaking into the shaft 30. The cover includes a nozzle 28 around which a solution channel 26 is snuggly secured. The solution channel includes a tubular structure that runs through the shaft 30 and connects to an inlet 70 in an outer wall of a discharge nozzle 90. The cover also includes a nozzle 29 around which a recirculation channel 25 is snuggly secured. The recirculation channel includes a tubular structure that runs from the discharge nozzle, through the shaft and back to the reservoir. Advantageously, excess bubble solution drains from the discharge nozzle and back into the reservoir for reuse and recirculation.

The shaft 30 is preferably made of a lightweight, but durable material, such as plastic that can withstand being dropped without breaking. As shown in FIGS. 1-4, the shaft is hollow and is made of one monolithic piece or includes a front 34 and back 32 section, that are secured together, for instance via screws, see FIG. 4. As shown in FIGS. 3-4, the shaft preferably includes a power source for activation of the toy 10. The power source being, for example, batteries 35, which are secured within a battery compartment 36 located in a back side of the shaft. The battery compartment includes a cover 38 that secures the batteries within the compartment, for instance via screws. The batteries are electrically connected to a switch 40, such as a slide switch, which forms part of the shaft. This switch is multi-functional and controls and activates various functions and features of the toy. For example, as shown in FIGS. 2-4, the switch is a three-way slide switch and while in the middle position, the toy is off. When a user slides the switch to the right, various light emitting diodes 37 ("LEDs") secured within the toy are activated. The LEDs vary in color, luminosity, and intensity, so when activated, a magnificent light show appears. Further, as shown in FIG. 1, the housing 50 includes a face etched therein, such as a jack-o-lantern face, so when the LEDs illuminate, the Jack-o-lantern appears to be talking or animated. When a user slides the switch to the left, the bubble engine 52 is activated and bubbles are produced from the discharge orifice 86.

Advantageously, as shown in FIGS. 3-4, the toy 10 includes a separate button 42 for the activation of the smoke cartridge 100. Accordingly, the toy produces bubbles, fog, and/or fog-filled bubbles simultaneously or independently. The button is electrically connected to a separate cartridge battery 103, such as a lithium battery, which is secured within the housing 50.

In one embodiment, both the cartridge battery 103 and the batteries 35 include a fuse that protects them from overheating by cutting the power if temperatures rise above safety limits.

As shown in FIGS. 3-4, the toy 10 includes circuitry and/or control circuitry, such as a printed circuit board or microcontroller unit 39, which controls the various electrical operations of the toy. The printed circuit board is preprogrammed to connect the electronic components of the toy to one another in a controlled manner. In addition, or in place thereof, the switch 40 and button 42 include a software or signal-controlled switch that is controlled by an internal controller. Accordingly, the circuitry of the toy is communicatively activated by a remote device or is motion sensor activated. For example, the switch or other circuit incorporate activation through embedded instructions and or receipt of activation signals. For example, the control circuitry includes a receiver, which activates the illumination of the LEDs, the bubble production and/or smoke production of the toy. The switch or other circuitry, for example, includes proximity detection devices, such as, for example, RFID or other types of electronics, which sense location, proximity or other wireless operations, which provide instructions for or instruct illumination, bubble or smoke production of the toy. For example, the circuitry is operable to detect location in respect to a transmitted beacon. For example, the toy automatically activates upon nearing a display, feature, attraction, or other location within an amusement park which is transmitting a unique beacon. When received by the toy, it begins illuminating or producing smoke and/or bubbles in a predetermined manner.

In one embodiment, the toy 10 includes a sender that transmits a signal to a display, feature, attraction of other location within an amusement park. Accordingly, when a user holding the toy nears a display, feature, attraction, or other location which receives a unique beacon being sent from the toy, the display, feature, attraction etc., is activated in a predetermined manner.

As shown in FIGS. 3-4, further secured within the shaft 30 and electrically connected to the printed circuit board 39 is a speaker 33 and a microphone 31. The control circuitry, for example, includes programming for a sound chip, which is preprogrammed with various audio files. Accordingly, the toy produces bubbles, smoke and/or smoke-filled bubbles in synchronization with sound played through the speaker and/or ambient sound when detected by the microphone. Included in the possible automated instruction of the circuitry includes playing predefined audio stored in memory of the toy or received by the receiver of the toy, playing signals which are streamed and received by the integrated receiver, and similar functionality.

As shown in FIG. 4, the housing 50 is made of one monolithic piece of plastic or consists of front 51 and back 53 portions secured together, for instance via screws. As shown in FIGS. 3-4, a bubble engine 52 is secured within the housing 50. The bubble engine includes the components necessary for producing bubbles, which components are secured within a molded casing 54 inside the housing. This casing protects the components from any potential leakage of bubble solution or oil. The bubble engine is like the bubble engine utilized by the bubble wand, which is made by Applicant and disclosed in U.S. application Ser. No. 17/335,447, which application is incorporated by reference herein in its entirety. The bubble engine includes a motor 66 that is electrically connected to a pump with a gearbox, a drive shaft 88 connected to a wiper 85 and an air producing device 64. The motor efficiently produces the amount of energy needed to rotate the wiper via the drive shaft, which produces the desired quantity of bubbles without overproduction, see FIG. 5. Further, the motor is connected to the air producing device 64 and generates the precise air flow rate needed to create the desired quantity of bubbles and smoke. Further, the toy advantageously uses less electric current because of the slowed speed of the motor, therefore increasing battery life of the toy.

To further aid in producing the desired size and quantity of bubbles is the type of pump used, which is preferably a peristaltic pump. This pump is connected to the gearbox, which includes a plurality of gears that control the speed of the pump to produce the precise number of bubbles per minute. The pump operates in combination with the motor 66 and gearbox, to draw the bubble solution from the reservoir 20 through the solution channel 26. The channel extends from the reservoir, through the shaft 30, and the pump. The channel secures to an inlet 70 located in a wall of the nozzle 90, see FIG. 5. Solution drips through the inlet and onto a trough 76. The wiper 85 rotates 360 degrees around the trough to form a film of bubble solution.

Figure 5:
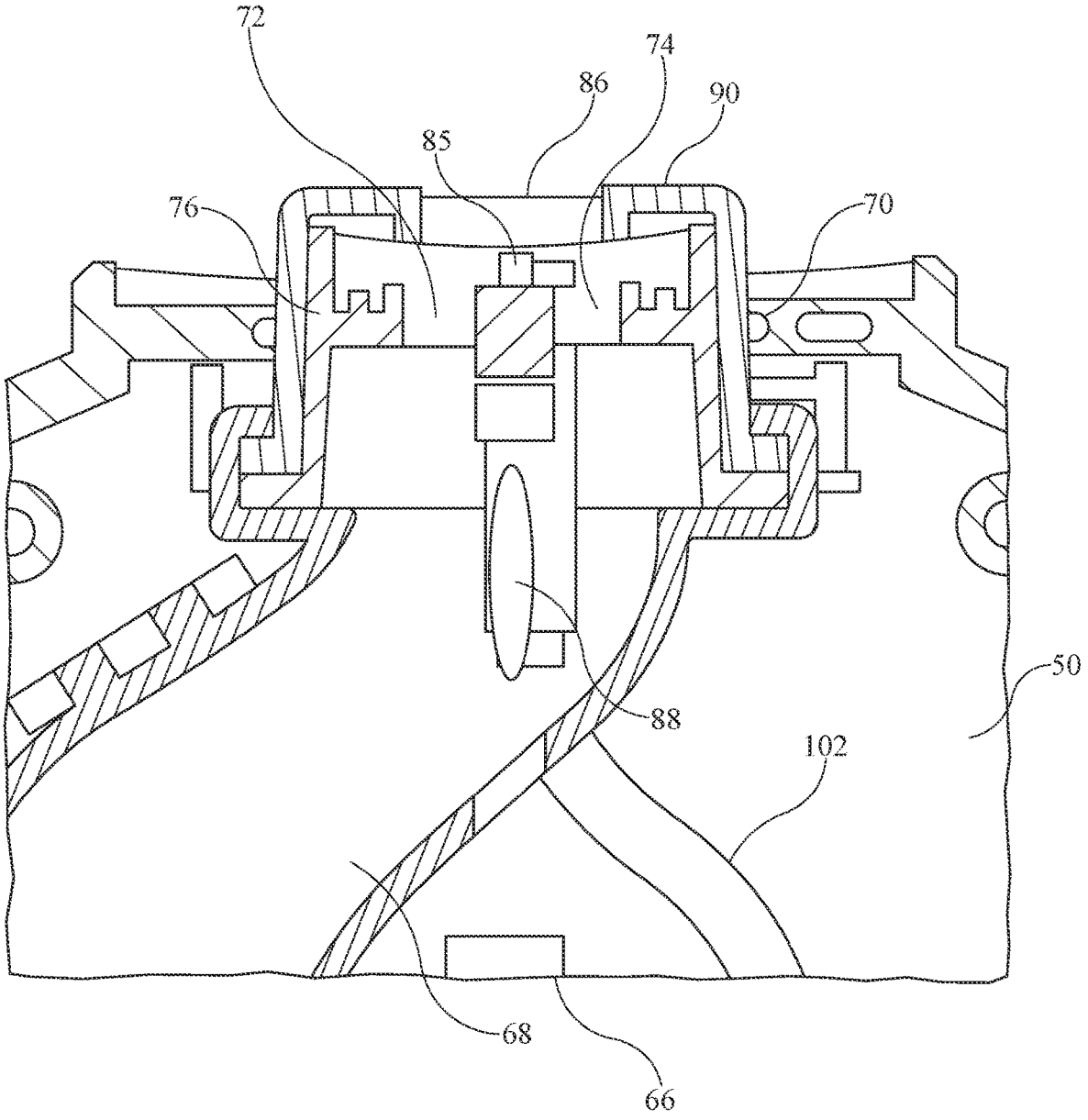
FIG. 5 is a cross-section view of a top portion of a housing of the toy that produces bubbles, smoke, and smoke-filled bubbles shown in FIG. 1.

The motor 66 is electrically connected to the air producing device 64. As shown in FIGS. 4-5, the air producing device is, for example, a fan that produces an air stream with the velocity needed to push the film of bubble solution through the discharge orifice 86 to create a bubble. Further, fan must also produce an air stream with enough velocity to push smoke from the air cartridge 100 to the air duct 68. Air from the air producing device and from the smoke cartridge is pushed into the air duct, which is a hollow tube that is secured to, part of, or formed by the outer casing 54 of the bubble engine. The air duct is bent at an angle, which aids in providing the precise air flow to create the desired quantity of bubbles.

As shown in FIGS. 3-5, a top portion of the air duct 68 is connected to a bubble and smoke discharge nozzle 90. As shown in FIG. 5, the nozzle includes a trough 76 that surrounds the outer circumference of the upper portion of the nozzle. The trough includes a connection point 70, to which the solution channel 26 connects and drips solution onto the trough at a precise rate defined by the pump and gearbox. Further connected to the trough is a drain to which the recirculation channel 25 connects to recirculate excess liquid back to the reservoir 20. Centrally located within the trough are two open semi-circle portions (72, 74), around which the wiper 85 rotates 360-degrees. The wiper is centrally located within the trough to the wiper shaft 88, which extends into the housing 50 and connects to the motor. When rotating, the wiper extends to the outer edges of the trough and rotates over the two semicircle openings to create a film of bubble solution. Air blown from the air producing device 64, travels through the air duct and into the film, which is emitted from the discharge orifice in the form a bubble. For example, in use, when a user slides the switch 40 to the left, the bubble engine 52 is activated. Accordingly, the pump begins pumping bubble solution from the reservoir 20 via the solution channel through the shaft 30 and to the trough. Solution collects in the trough as the wiper rotates 360 degrees, a film is created over the two semi-circle portions. Subsequently, air is pushed upwardly from the air producing device, through the air duct beneath the two semicircle portions. The air pushes the film into a bubble, which bubble is emitted out of the discharge orifice. Further secured to an outer portion of the nozzle cover is a gasket or sealing device that presses against the housing to make the toy water resistant.

Advantageously, smoke is also created and pushed through the air duct 68 and into the film to create smoke-filled bubbles and smoke. As shown in FIGS. 3-4 and 6-8, a smoke cartridge 100 is secured within the housing 50 via a compartment 101. The air producing device 64 is connected to the cartridge via a smoke air channel 102, which flows from the air producing device, through the cartridge and reconnects to the air duct 68. The location of where the smoke air channel connects to the air duct is beneficial in producing both smoke bubbles and smoke. In use, air is pushed through the air duct, where it conjoins with the smoke, which is eventually pushed upward through the bubble film to create smoke-filled bubbles. In addition, some smoke is pushed through the discharge orifice 86 by itself, creating an aesthetically pleasing effect of smoke and smoke-filled bubbles.

Figure 6:
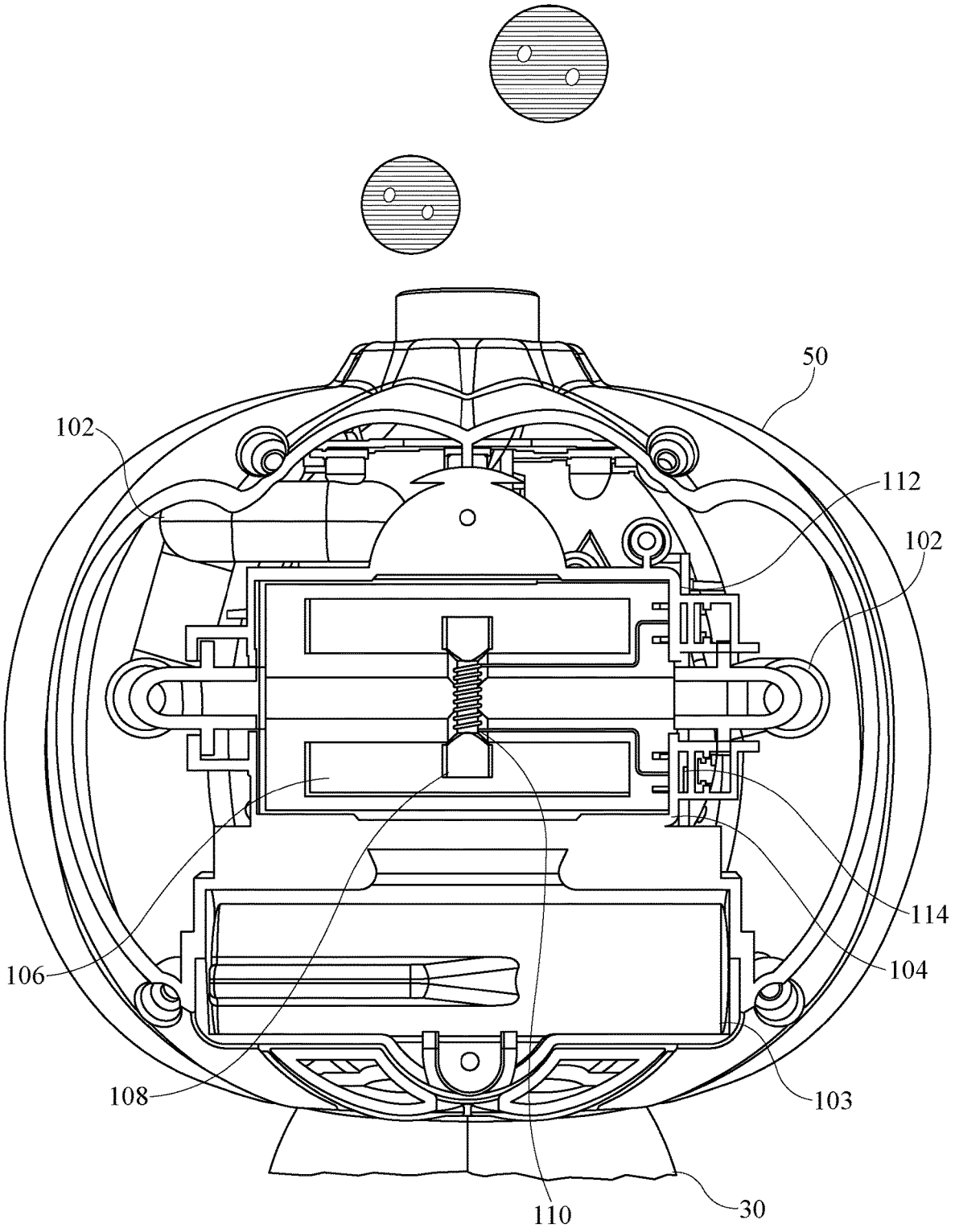
FIG. 6 is a cross-section back view of a smoke cartridge and cartridge battery, which are secured within the housing of the toy that produces bubbles, smoke, and smoke-filled bubbles shown in FIG. 1.
Figure 7:
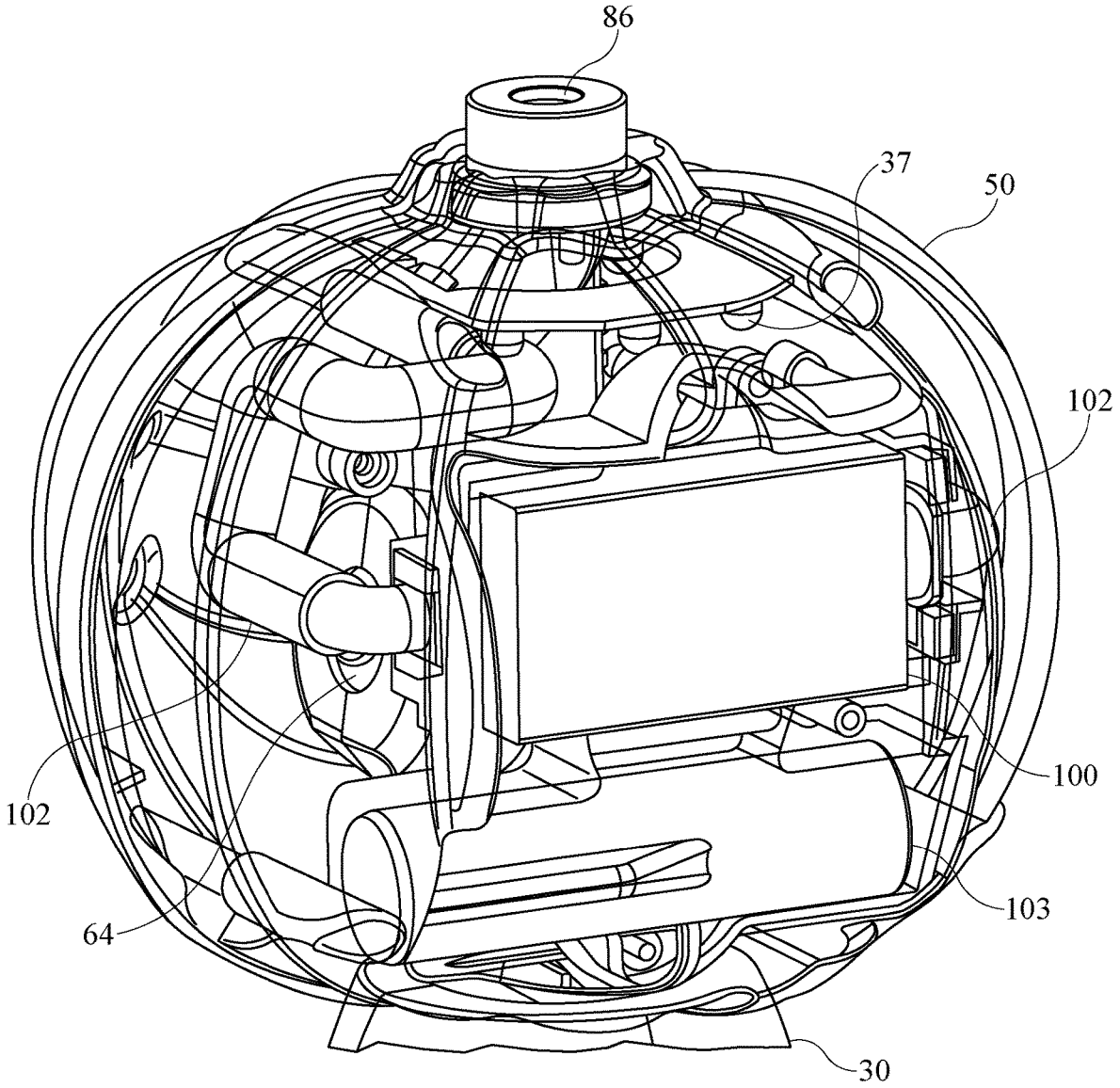
FIG. 7 is a back, perspective partially transparent view of the housing of the toy that produces bubbles, smoke, and smoke-filled bubbles shown in FIG. 1.
Figure 8:
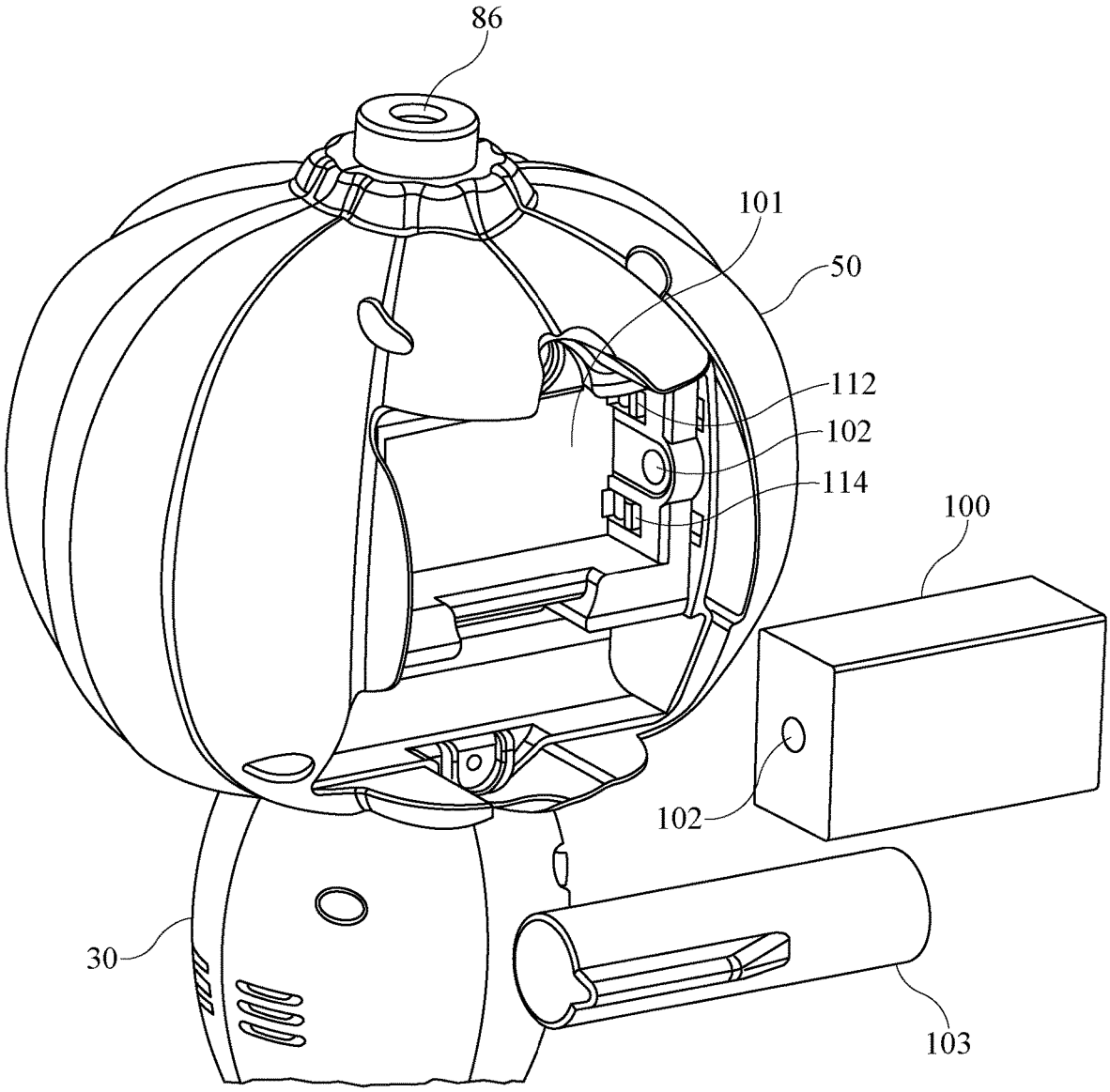
FIG. 8 is a back, perspective view of the housing of the toy that produces bubbles, smoke, and smoke-filled bubbles shown in FIG. 1 with the smoke cartridge and cartridge battery removed.

As shown in FIG. 6-8, the cartridge 100 includes an outer housing 104 for protection of the inner contents. The housing surrounds an oil reservoir 106, which contains oil that is vaporized into smoke. There is an oil intake located in an outer edge of the housing and reservoir, so the cartridge is refillable. As shown in FIG. 8, the cartridge is easily removeable for replacement or refilling. As shown in FIG. 6, soaked within the oil of the reservoir is a wick 108, which is threaded through the inside of a heater coil 110. The heater coil is secured within the middle of the smoke air channel 102 and is electrically connected to a negative 112 and positive terminal 114, see FIGS. 6 and 8. Accordingly, the oil that saturates the wick is vaporized via current, which flows through the coil via the terminals to create smoke. This smoke is pushed from the cartridge via air flowing through the smoke air channel. The smoke combines with air at the air duct 68.

Accordingly, in use, when a user presses the button 42, current begins flowing through the heater coil 110 via the negative 112 and positive terminals 114, which are electrically connected to the cartridge battery 103. The oil that has saturated the wick is vaporized into smoke. This smoke is pushed out the other side of the cartridge via the smoke air channel 102 and joins with the air vent. This smoke is driven upward through the film formed on the trough 76 to make smoke-filled bubbles, which are emitted through the discharge orifice 86. Furthermore, smoke is emitted through the discharge orifice independently of the bubbles.

It is well recognized by persons skilled in the art that alternative embodiments to those disclosed herein, which are foreseeable alternatives, are also covered by this disclosure. The foregoing disclosure is not intended to be construed to limit the embodiments or otherwise to exclude such other embodiments, adaptations, variations, modifications and equivalent arrangements.

The invention claimed is:

1. A bubble, smoke, and smoke-filled bubble producing toy comprising:

a shaft with a first and second end;

a bubble producing solution reservoir connectable to the first end of the shaft;

a housing connected to the second end of the shaft;

a bubble producing engine secured within the housing;

a speaker and a microphone secured within the shaft, wherein activation of the smoke-filled bubbles occurs in synchronization with a sound when the sound is played through the speaker;

an air blower secured within the housing and connected to a first end of an air duct;

a smoke cartridge secured within the housing and connected to the air blower via an air channel, which channel flows through the air cartridge and joins with the air duct;

a bubble and smoke discharge nozzle secured to a second end of the air duct, wherein the nozzle comprises a bubble film producing assembly and a discharge orifice;

a channel comprising a tubular structure with two ends, wherein a first end is submerged within the solution reservoir and a second end is connected to the film producing assembly;

a slide switch secured within the shaft, wherein the slide switch activates a first and second mode of the toy, wherein bubble production is automatically activated when the toy is in the first mode; and a button secured within the shaft, wherein the button activates the smoke cartridge to produce smoke without bubble production when the toy is in the second mode.

2. The toy of claim 1, wherein the bubble film producing assembly comprises a trough surrounding an inner edge of the nozzle, wherein the trough includes two open semicircle portions with a wiper centrally located therein.

3. The toy of claim 1, further comprising a recirculation channel comprising a tubular structure with two ends, wherein one end is connected to the bubble film producing assembly and the other end is submerged within the solution reservoir.

4. The toy of claim 1, wherein the bubble engine comprises a motor and a pump, which are electrically connected to a power source.

5. A bubble, smoke, and smoke-filled bubble producing toy comprising:

a shaft with a first and second end;

a bubble producing solution reservoir connectable to the first end of the shaft;

a housing connected to the second end of the shaft and containing LEDS;

a bubble producing engine secured within the housing;

a speaker and a microphone secured within the shaft, wherein activation of the smoke-filled bubbles occurs in synchronization with a sound when the sound is played through the speaker;

an air blower secured within the housing and connected to a first end of an air duct;

a smoke cartridge secured within the housing and connected to the air blower via an air channel, which channel flows through the air cartridge and joins with the air duct;

a bubble and smoke discharge nozzle secured to the second end of the air duct, wherein the nozzle comprises a bubble film producing assembly and a discharge orifice;

a channel comprising a tubular structure with two ends, wherein a first end is submerged within the solution reservoir and a second end is connected to the film producing assembly;

a slide switch secured within the shaft, wherein the slide switch activates a first and second mode of the toy, wherein bubble production is automatically activated when the toy is in the first mode; and a button secured within the shaft, wherein the button activates the smoke cartridge to produce smoke with or without bubble production when the toy is in the second mode.

6. The toy of claim 5, wherein the bubble film producing assembly comprises a trough surrounding an inner edge of the nozzle, wherein the trough includes two open semicircle portions with a wiper centrally located therein.

7. The toy of claim 5, further comprising a recirculation channel comprising a tubular structure with two ends, wherein one end is connected to the bubble film producing assembly and the other end is submerged within the solution reservoir.

8. The toy of claim 5, wherein the bubble engine comprises a motor and a pump, which are electrically connected to a power source.

* * * * *